US006179294B1

(12) United States Patent
Turnali

(10) Patent No.: US 6,179,294 B1
(45) Date of Patent: Jan. 30, 2001

(54) MY CENTURY CARD GAME APPARATUS

(76) Inventor: Kaan Turnali, 109 Painters Crossing, Chadds Ford, PA (US) 19317

( * ) Notice: Under 35 U.S.C. 154(b), the term of this patent shall be extended for 0 days.

(21) Appl. No.: 09/273,146

(22) Filed: Mar. 19, 1999

(51) Int. Cl.[7] ..... A63F 1/00
(52) U.S. Cl. ..... 273/302; 273/308; 273/292
(58) Field of Search ..... 273/308, 298, 273/292, 429, 430, 431, 432, 243, 249, 307

(56) References Cited

U.S. PATENT DOCUMENTS

| | | | | |
|---|---|---|---|---|
| 972,371 | * | 10/1910 | Hammett | 273/302 |
| 1,213,839 | * | 1/1917 | Conrad | 273/307 |
| 5,083,794 | * | 1/1992 | Santagata | 273/249 |
| 5,186,467 | * | 2/1993 | Chasin | 273/298 |
| 5,660,389 | * | 8/1997 | Freda, III | 273/249 |

FOREIGN PATENT DOCUMENTS

| | | | | |
|---|---|---|---|---|
| 2254565 | * | 10/1992 | (GB) | 273/249 |

OTHER PUBLICATIONS

"Time: The Game", John . Hanson Co., Games Magazine, Mar. 1984, p. 50.*

"Classic Major League Baseball Board Games", Classic Game Inc. Jan. 1993.*

* cited by examiner

*Primary Examiner*—Benjamin H. Layno
(74) *Attorney, Agent, or Firm*—Robert B. Famiglio; Famiglio & Associates

(57) ABSTRACT

A new and improved educational and entertaining card game is disclosed which employs chronologically based information, established and displayed in a unique format. The game includes a variety of different instruction sets which allows the play of the game to be varied while still using the same cards. The present invention provides a basis for substantial flexibility in developing new rules for the play of the game using the same apparatus disclosed herewith. The front side of the game card displays a year within the twentieth century. Each such card also contains an array of facts placed in the order of category and aligned with an icon which is used in the scoring of the game. The game card apparatus allows scoring by a variety of different parameters including matching up certain category icons which are related to historical events in each of several different categories. Scoring is also accomplished through the matching of the years of designation on the playing cards. The play of the game may be altered by application of a different instruction set while still using the same apparatus game cards disclosed in the present invention. In such a fashion, different levels of difficulty and skill can be required depending on the preference of the user.

1 Claim, 19 Drawing Sheets

Total 495

| Row 1 | Count | Row 2 | Count | Row 3 | Count | Row 4 | Count | Row 5 | Count |
|---|---|---|---|---|---|---|---|---|---|
| Art | 4 | Basketball | 4 | Camera | 1 | Earthquake | 4 | Baseball | 10 |
| Bottle | 3 | Boxing | 6 | Car | 20 | Government | 14 | Celebrate | 2 |
| Club | 3 | Cartoon | 10 | Car Race | 3 | Microscope | 12 | Chess | 3 |
| Crown | 6 | France | 2 | China | 4 | Money | 7 | Female | 8 |
| Disaster | 4 | INC | 7 | Elvis | 6 | Music | 17 | Football | 4 |
| Disney | 4 | Independence | 6 | Guitar | 8 | New York | 12 | Golf | 5 |
| Drinks | 3 | Peace | 13 | Movie | 35 | Nobel | 5 | Invention | 27 |
| Forks | 6 | Press | 10 | Oscar | 3 | Olympics | 7 | Mail | 4 |
| Germany | 5 | Science | 9 | Protest | 5 | Phone | 2 | President | 12 |
| PC | 7 | Tennis | 7 | Sea | 9 | Supermarket | 13 | Russia | 8 |
| Plane | 14 | Traffic Light | 4 | | | TV | 10 | Soccer | 7 |
| Police | 4 | UK | 8 | | | | | Turkey | 3 |
| Space | 12 | US Flag | 8 | | | | | | |
| Terror | 11 | | | | | | | | |
| War | 21 | | | | | | | | |
| World | 4 | | | | | | | | |
| Total = | 111 | Total = | 94 | Total = | 94 | Total = | 103 | Total = | 93 |

Fig. 17

MY CENTURY CARD GAME APPARATUS

BACKGROUND OF INVENTION

The present invention relates the games and methods of play, and more particulary pertain to a new and improved card game wherein the game directs an association with a particular year and event within the twentieth century and provides educational entertainment by providing an understanding of various categories of knowledge of the century. The invention uses an array of distinctive icons in conjunction with playing cards to designate various categories or identification of categories which relate to events occurring during the twentieth century. The unique method of the play of the game involves scoring methods which utilize the icons on the playing cards, representing categories of historical knowledge and chronological events relating to the twentieth century. Other periods in history may be employed as well. Games found in the prior art utilizing historical facts are based on knowledge of trivial facts. Such games which presently exist rely on the memory of the player to answer questions based on trivia as to historical events, regardless of the category. In the present invention, relation of a theme or category of historical events is key to understanding the difference in the play of the game. A player in the present invention need not have a mastery of trivia in order to be successful in the play of the game. To the contrary, during the play of the game and in the matching of categories and icons relating to historical facts, the player can gain a knowledge of history and learn facts that he or she did not know until the play of the game.

SUMMARY OF THE INVENTION

The subject invention is comprised of generally rectangular playing cards which contain an array of historical facts associated with one of several category icons. Each playing card is unique with respect to a single year within the century in which a variety of events occurred. Icons may relate to subject matter such as art, a disaster, a space event, a sporting event, or even a geographical location. The card game described in the present invention is not scored in the conventional fashion. Rather than accumulate score points, the object of the game is to be the first player to eliminate any cards being held.

Although the game teaches historical facts, it is not necessary that a particular player know anything about the chronology of the historical events that are being presented on the face of each playing card. Rather, education from the game accrues from the attention given by each player to those facts presented on the face of the card when matching the icon from one card to that which may be present in two or more cards also held, during the play of the game, by an individual player. Conventional trivia games normally require the player to guess a year that a particular historical fact occurred. The present invention may be utilized in that fashion, if desired, by using the apparatus as a list of historical events that occurred on the year of that particular card. This is illustrative of yet one more flexible means of using the apparatus to devise new and interesting game strategies for the same set of cards. The icon on the playing card appears adjacent to a particular historical event under the category of the icon and always presents itself within the same row in the array of each card. By assigning a permanent row to a particular style of icon, the play of the game becomes less burdensome to a player who necessarily must match one icon from a card to an identical icon on another card he or she may draw. By way of example, an icon of a soda can would be adjacent to historical information regarding the first time a particular, popular, and well-known beverage was introduced. Another example of a frequently appearing icon is the war icon, which appears in the preferred embodiment more frequently than the soda can icon. In the play of the game, a particular player would only need to look within the first row of the array of cards placed before each player to determine whether he or she has an icon match that would be an acceptable scoring situation. Scoring is also accomplished by relating the year designation on each playing card with other cards held by a player such that sequential years can be used in the scoring protocol as described below. It should be pointed out, however, that it is possible to have a particular category icon on more than one row on a single card, if such an icon is appearing more than once on that card. Although a particular category icon has what may be referred to as a home row, in certain limited circumstances, two or three of the same category icons will appear on the same card with the second or third such icon appearing in rows other than the so-called home row.

The apparatus disclosed in the present invention may be used successfully in the play of the game in accordance with a variety of different instruction sets. The basic game contemplated allows players from two to eight individuals to play. The object of the basic game, known as the "Century Classic", is for an individual player to be the first to rid themselves of all the cards in the player's hand, by using a matching system. There are a variety of methods of keeping score, using penalty cards, wild cards and matching systems, all of which are described below in the detailed description of the drawing.

Having described the basics of the invention above, it should also be pointed out that the category of facts presented on the face of the playing cards can be associated with any culture or country, although the preferred embodiment described below presents world events as viewed through the American culture, it can be appreciated that other variations of the game can be based on a particular geographical area, another country's culture, sports events, movie events, or other specialized categories that might be of interest to the players of the game.

The invention described does not depend on any singular feature described above per say, but is an invention based on the particular combination of all of them disclosed and claimed and as distinguished in the combinations described hereafter. Though it has been described above, the more important features of the invention are such that the detailed description set forth below may be more easily understood, this summary of the invention is not meant to be all inclusive of the details of the game. There are, of course, additional features of the invention that will be described and which will form the subject matter of the claims appended hereto. Those skilled in the art of game design will appreciate that the conception, upon which this disclosure is based, might readily be utilized as a basis for the designing of other games, method structures, and systems for carrying out the purposes of the present invention. It is important, therefore, that the claims be regarded as including such equivalent constructions in so far as they do not depart from the spirit and scope of the present invention described.

It is therefore an object of the present invention to provide a new and improved card game which is based on a successful matching of icons which relate to various categories of historical facts taking place within the present century. It is another object of the present invention to provide a new and improved card game which is susceptible to both low cost of manufacturing with regard to materials required while providing a unique and educational experience to the card player in matching historical events to utilize in the scoring of the play of the game. It is yet another object of the present invention to provide a new and useful card game which provides in the apparatus and methods in the play of the game advantages with respect to flexibility of play utilizing the same apparatus described. It is still another object of the present invention to provide a new and improved trivia game wherein the same employs various categories of icons matched to historical events to direct the play of the game along a chronologically ordered series of playing cards defined wherein a matrix of icons and related historical events are presented on the face of each card associated with the year in a particular century assigned to said card. These, together with other objects of the invention, along with the various features of novelty which characterize the invention, are pointed out particularly in the claims appended hereto and form a part of this disclosure. The specific elements of the invention along with a description of their presentation and use are described below in the detailed description of the invention which should be read with reference to the drawings presented.

BRIEF DESCRIPTION OF THE DRAWINGS

The advantages of the invention will be better understood and objects other than those set forth above will become apparent when consideration is given to the detailed description of the preferred embodiment. Such description will make reference to the drawings included herewith wherein:

FIG. 17 is a chart illustrating the frequency of appearance of the category icons to formulate an alternative play of the game.

DESCRIPTION OF THE PREFERRED EMBODIMENT

Figure 1:
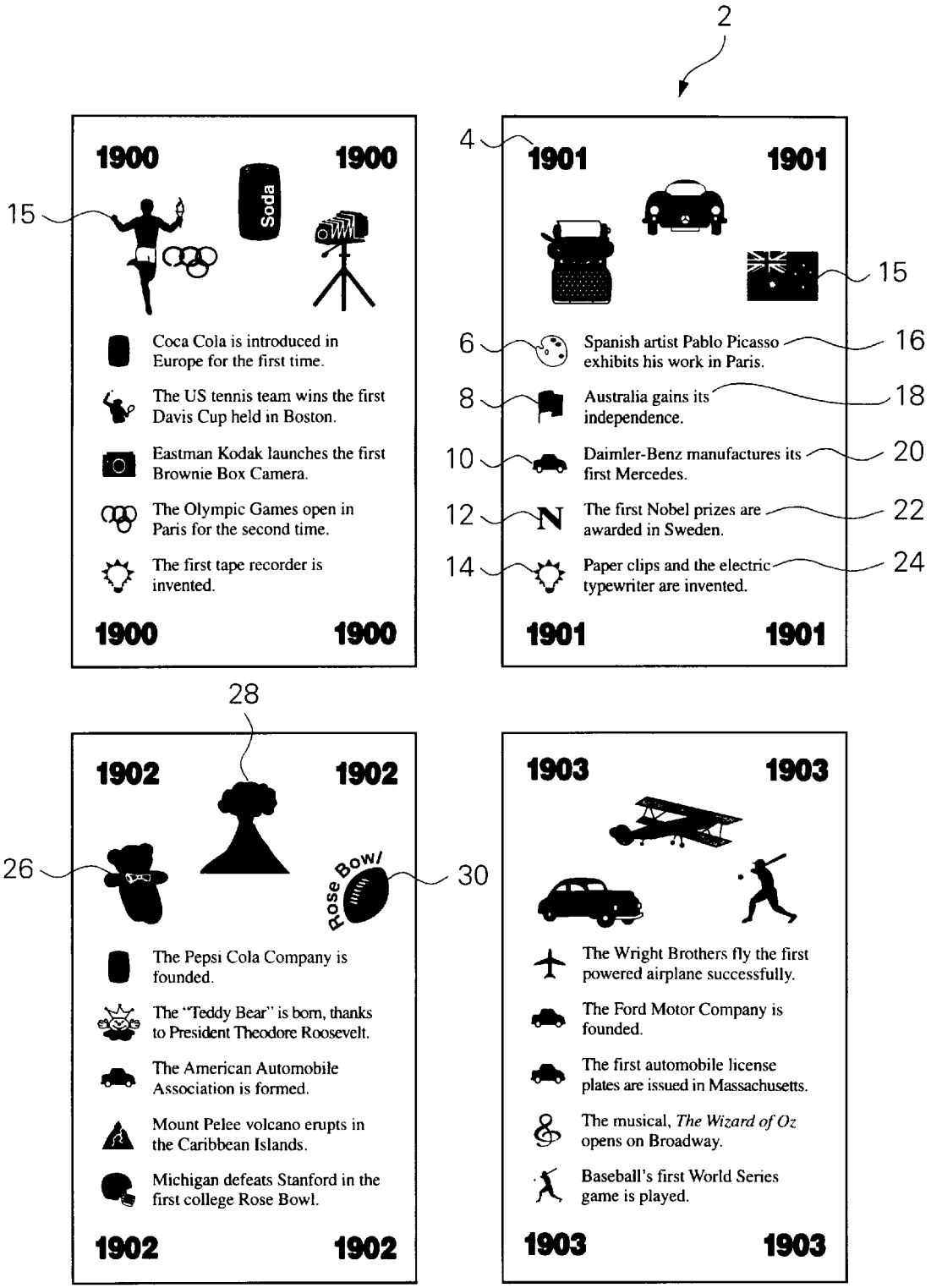
FIG. 1 is an illustration of typical cards used in the invention.
Figure 2:
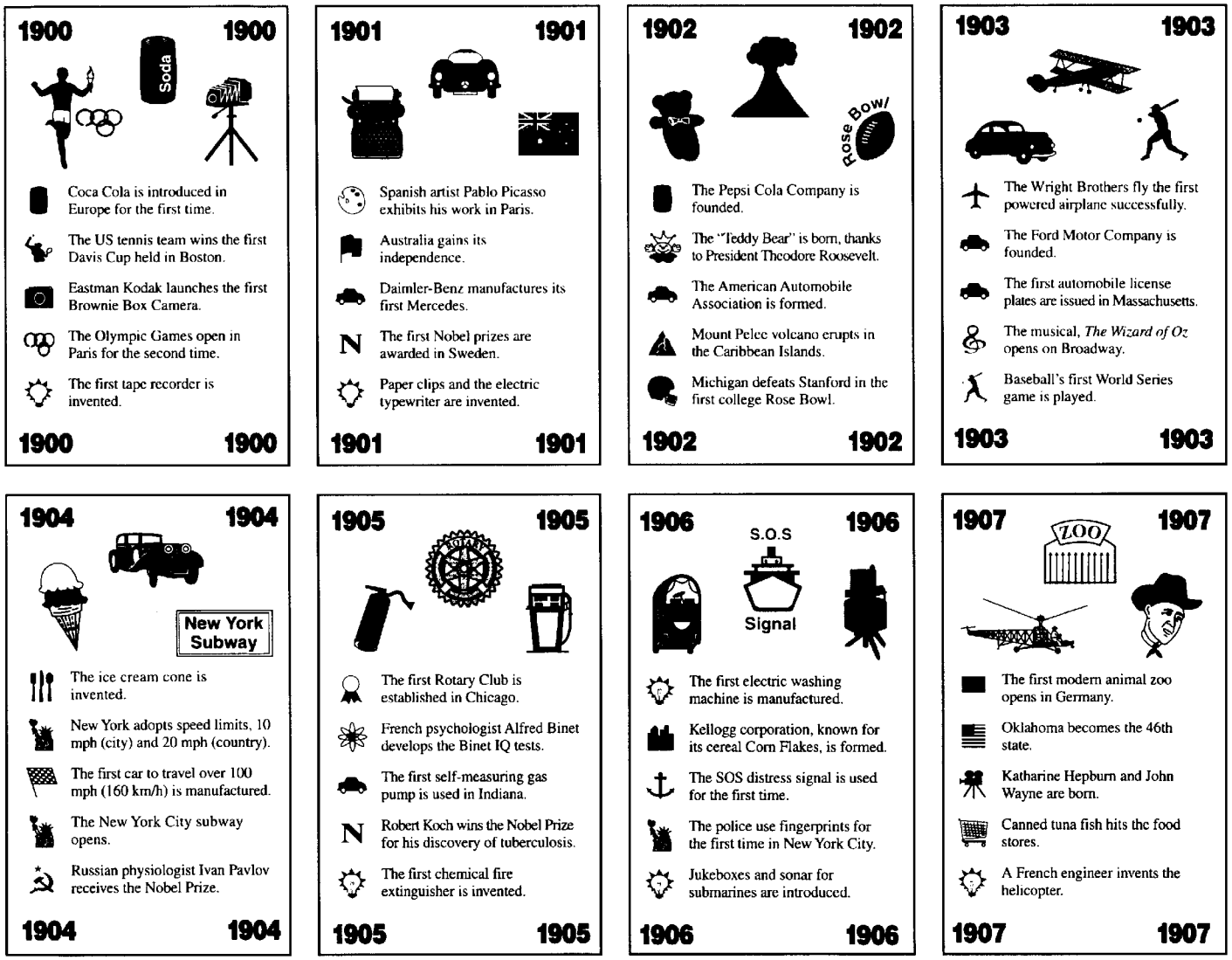
FIG. 2 through FIG. 15 is a plan view of all one hundred playing cards which are used in the present invention.
Figure 3:
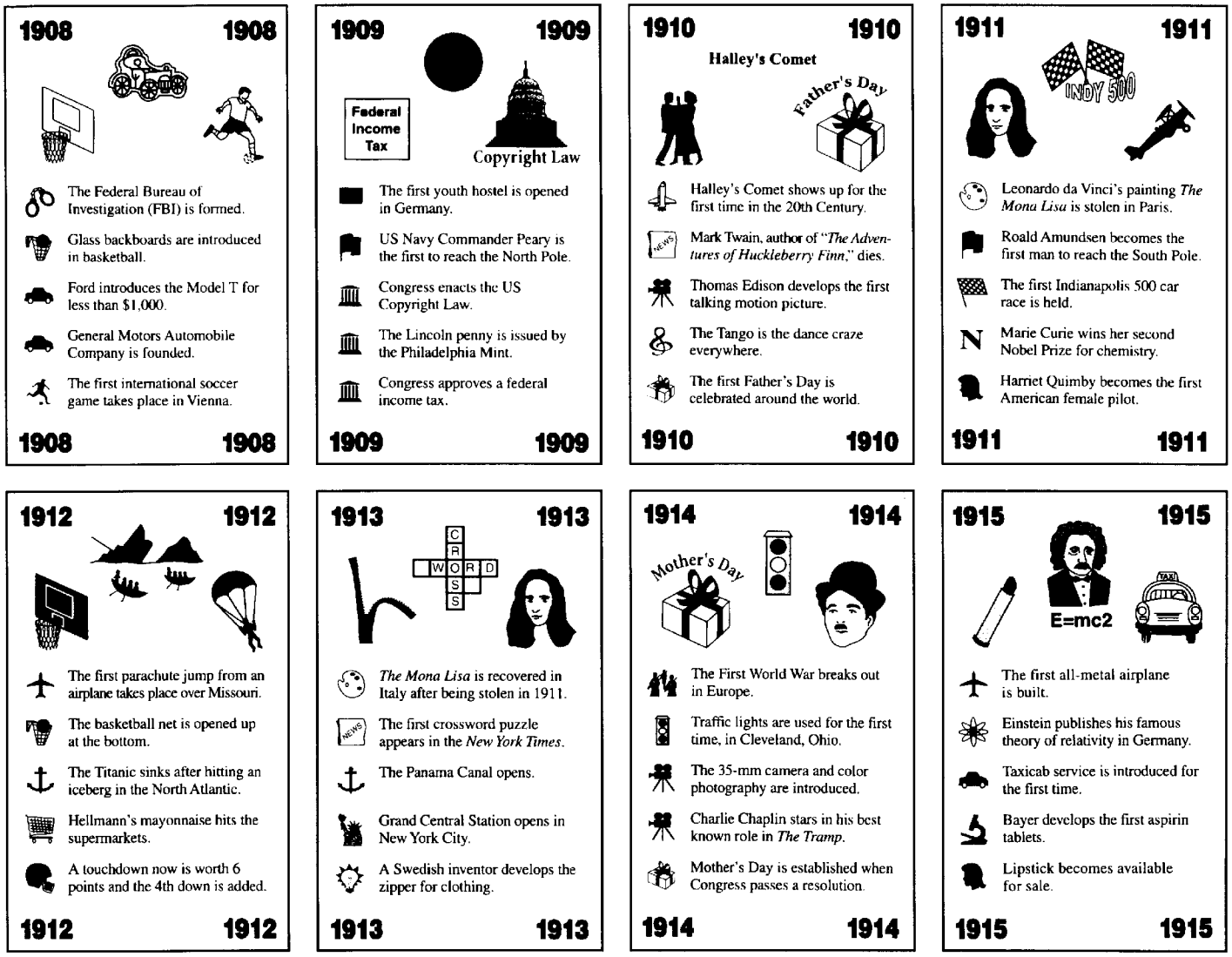
Figure 4:
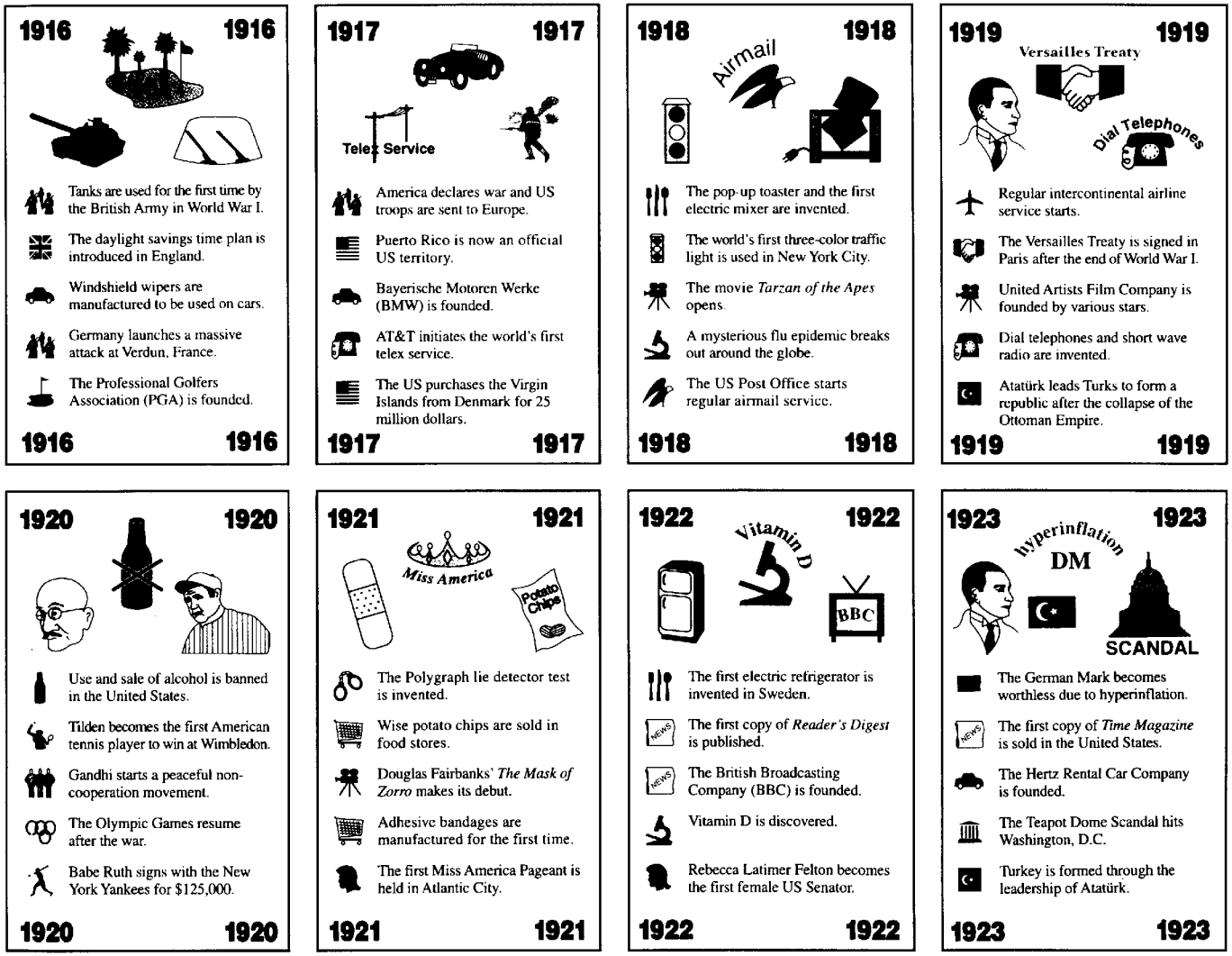
Figure 5:
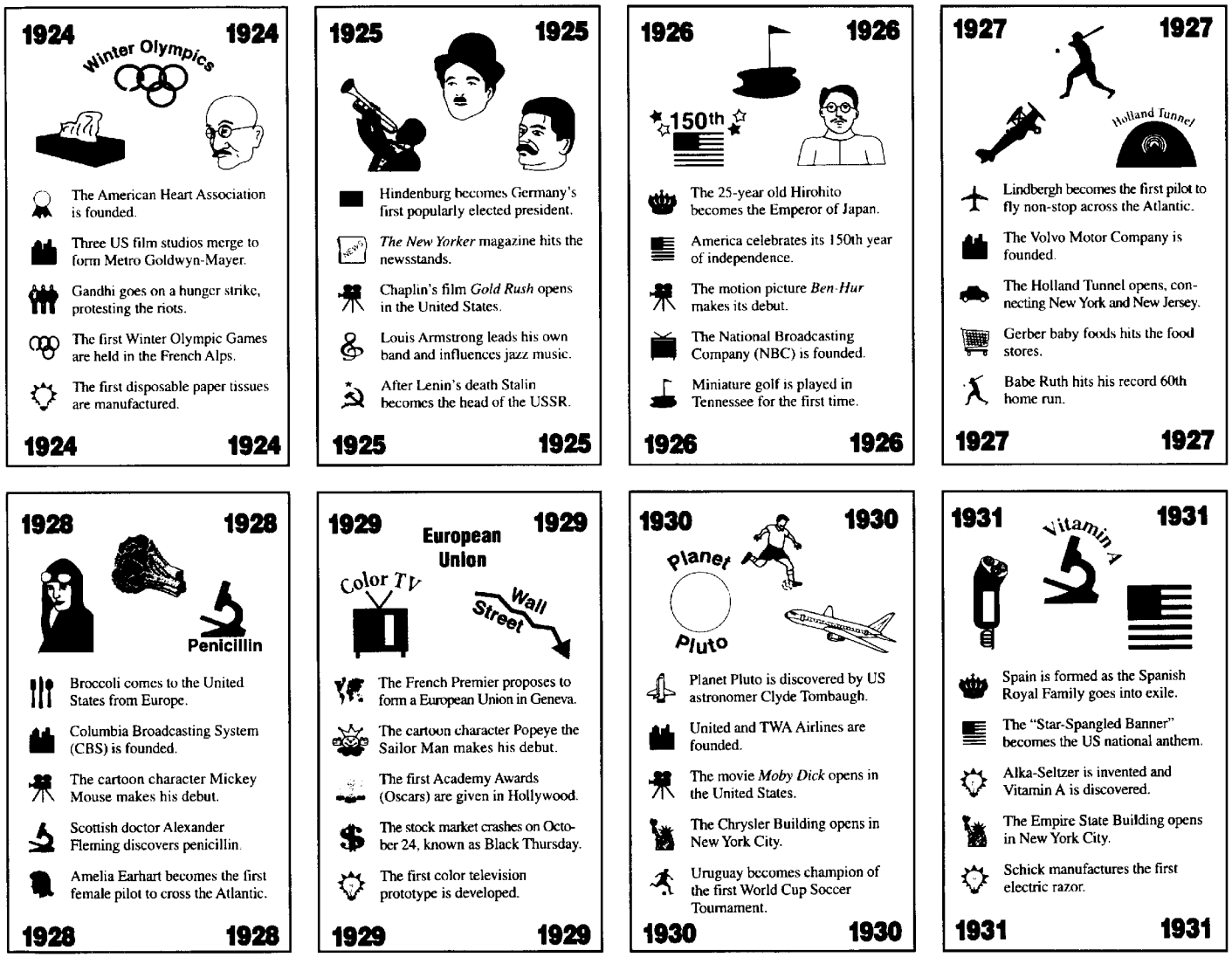
Figure 6:
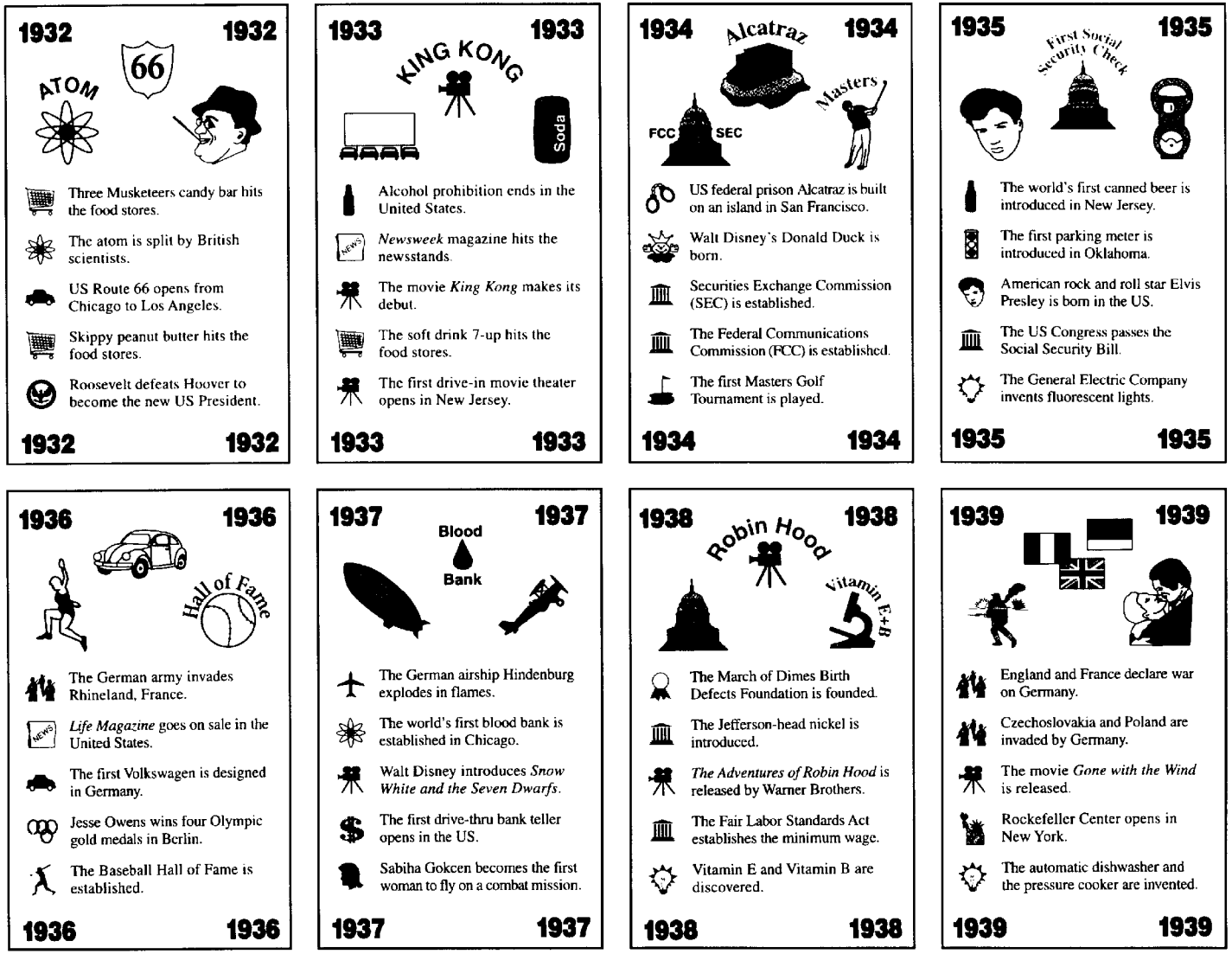
Figure 7:
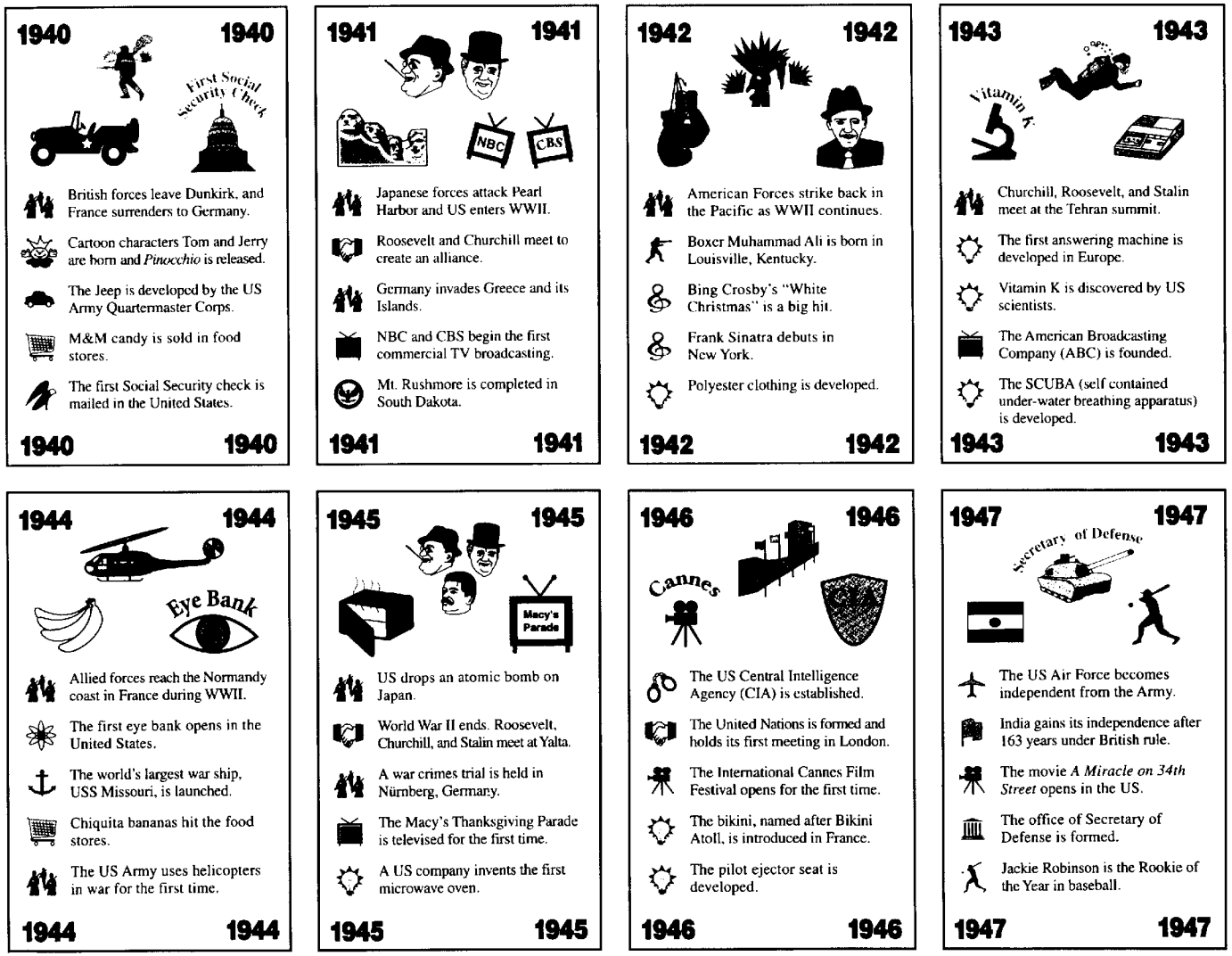
Figure 8:
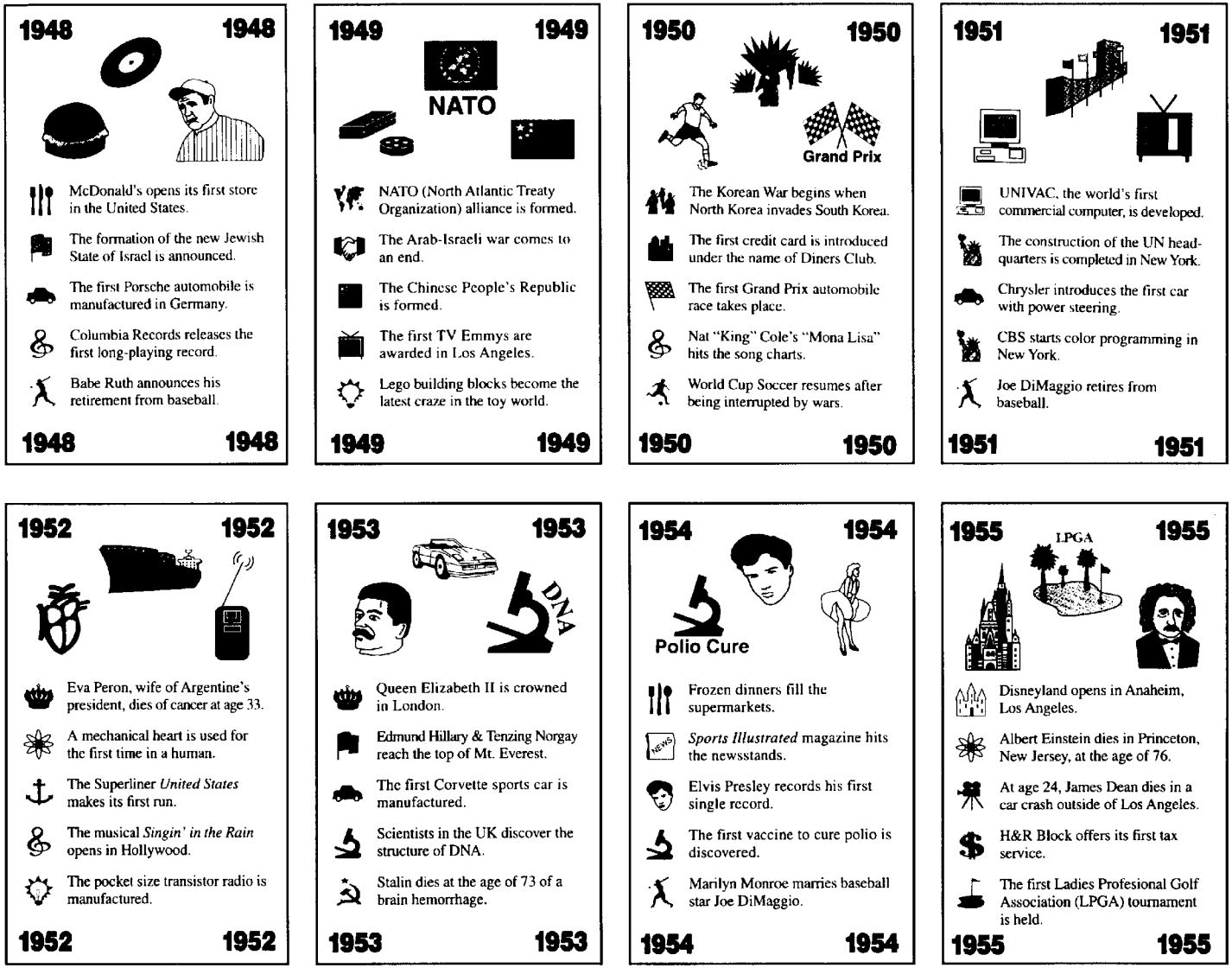
Figure 9:
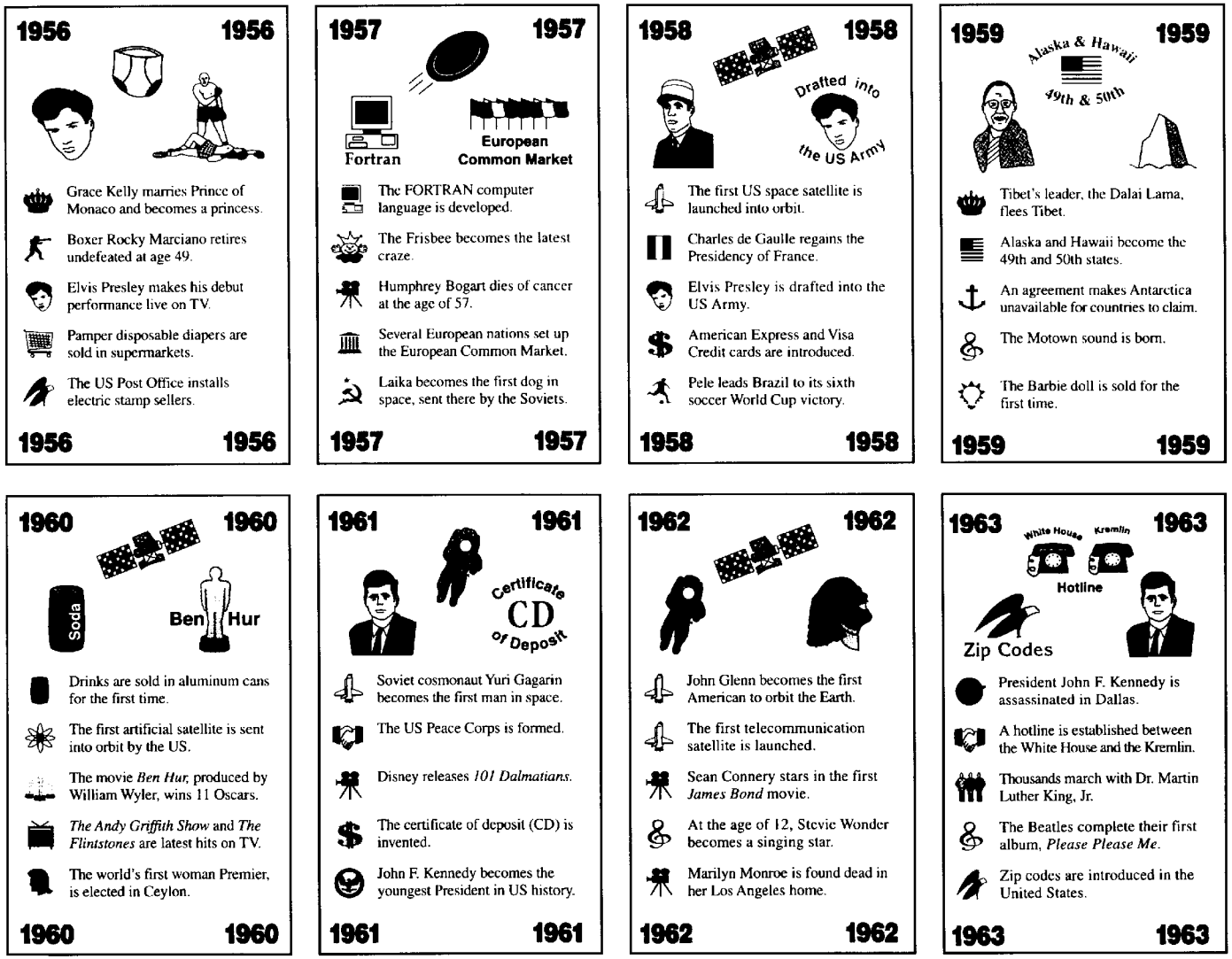
Figure 10:
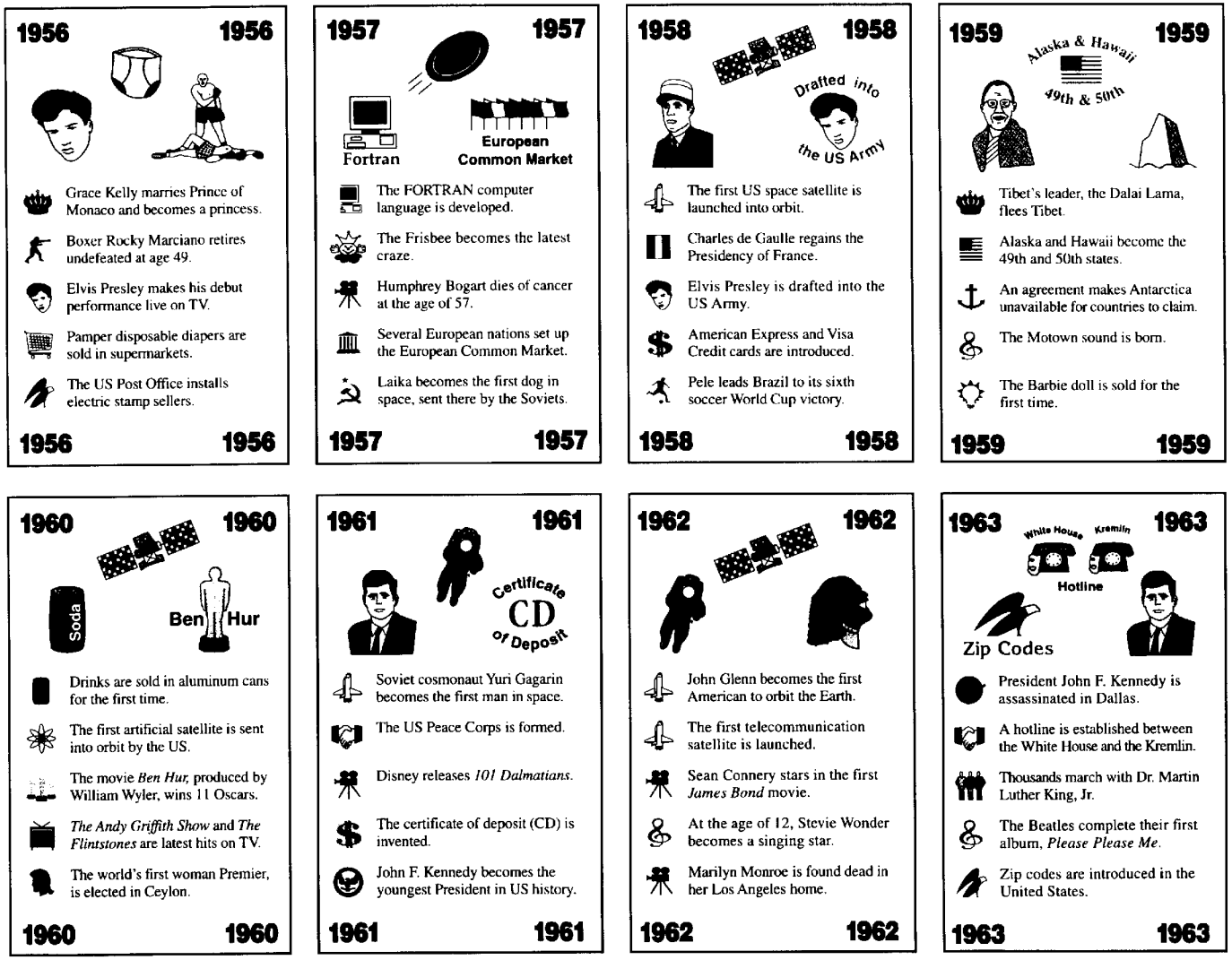
Figure 11:
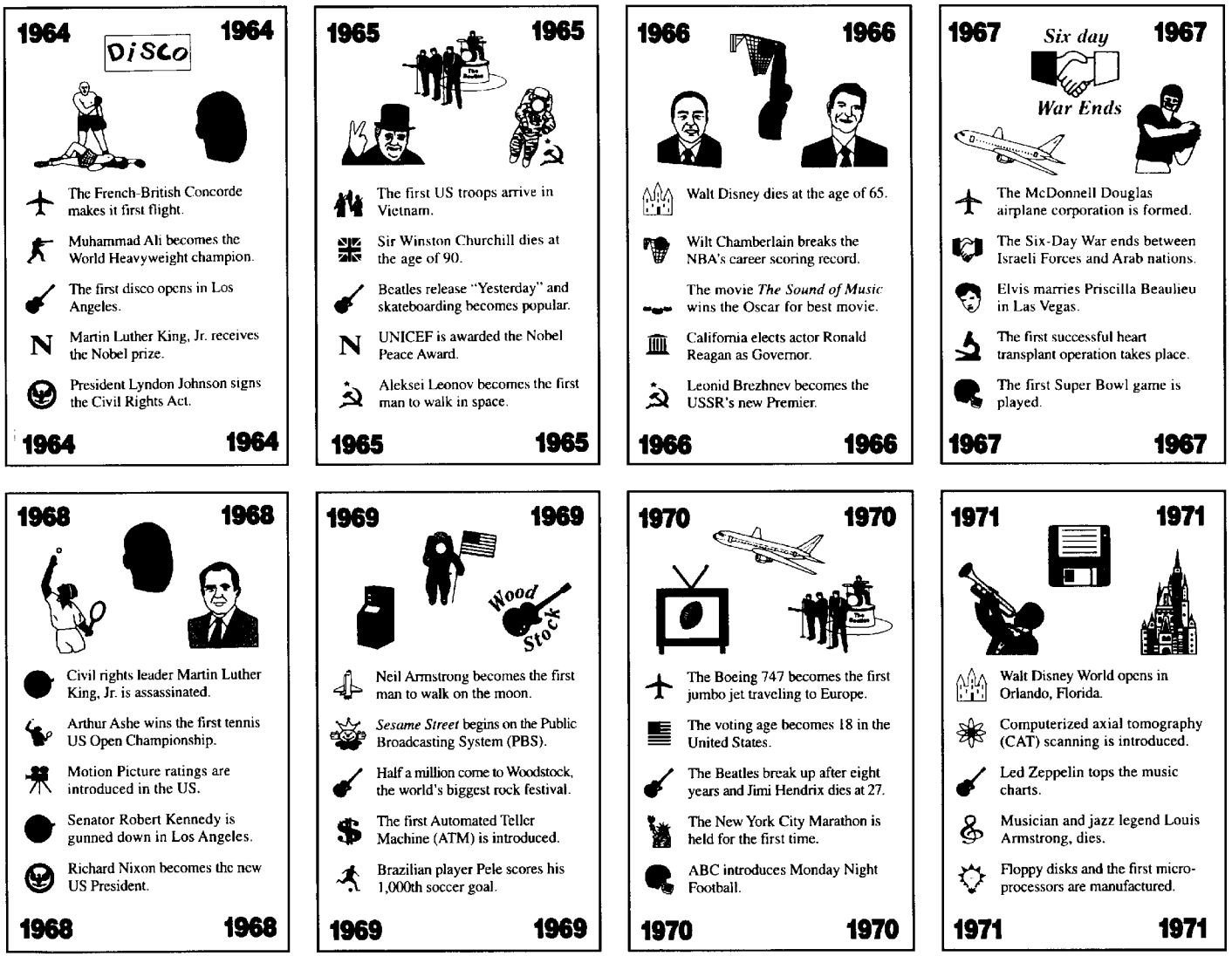
Figure 12:
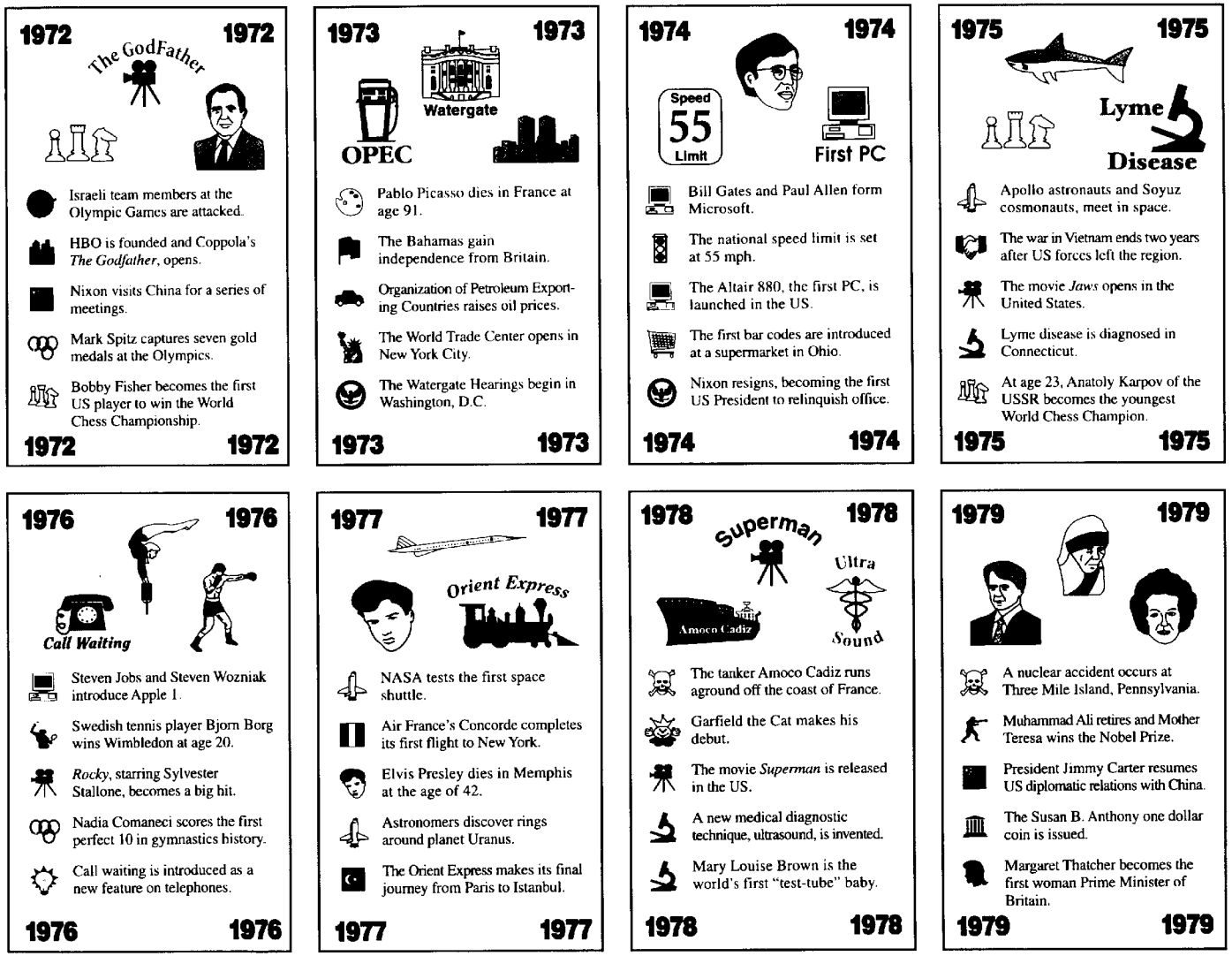
Figure 13:
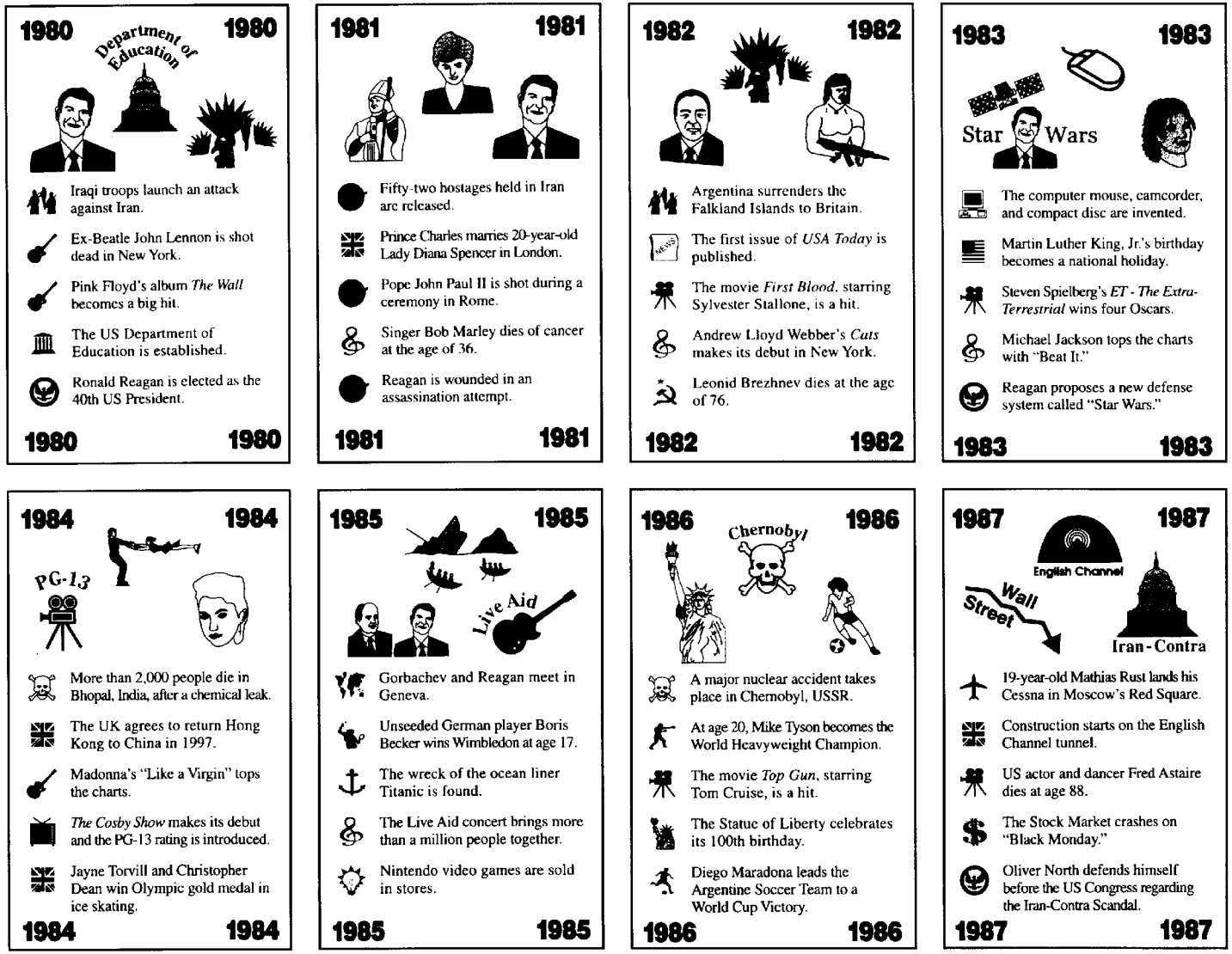
Figure 14:
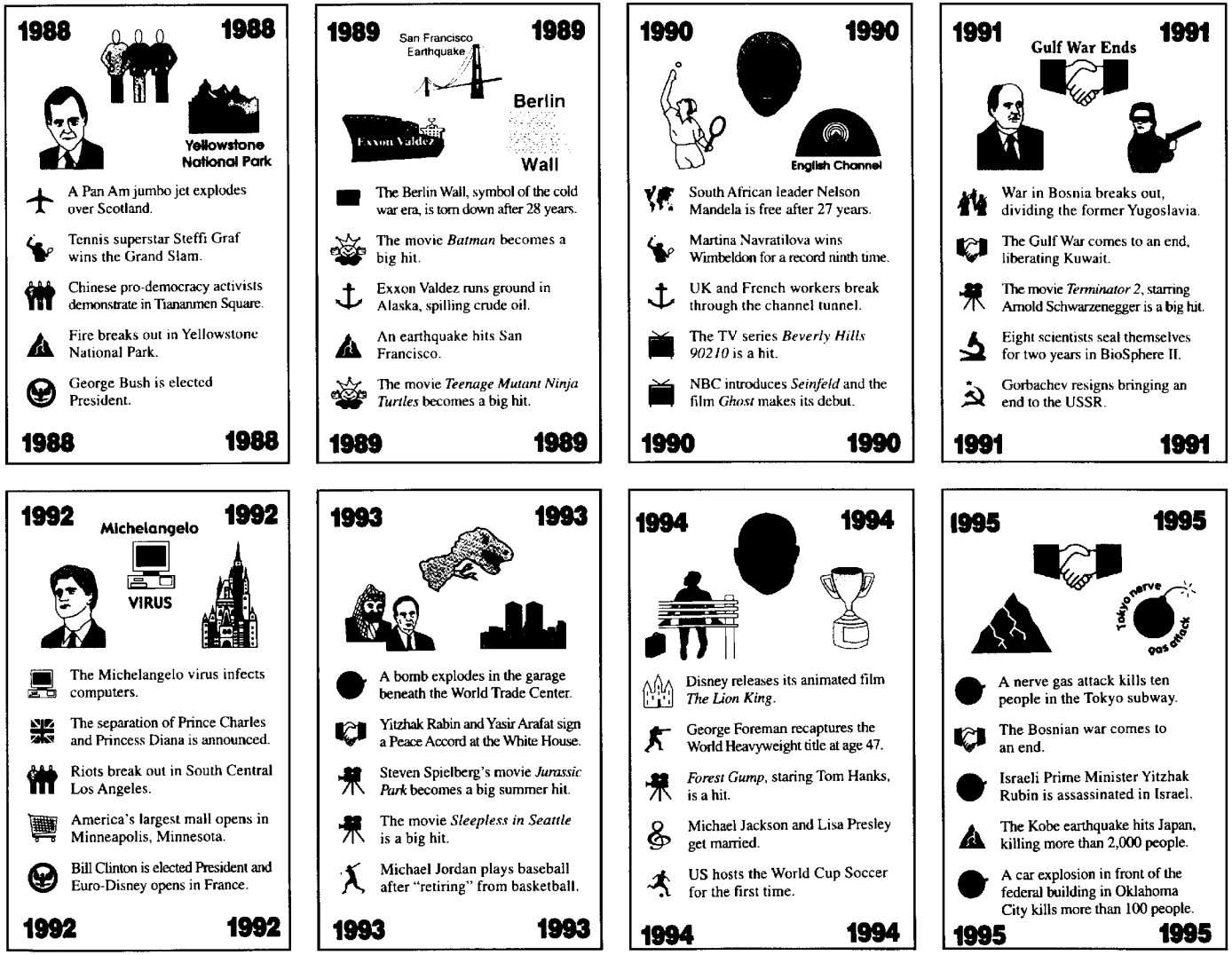

A detailed description of the invention along with the apparatus used in the play of the game of the invention will now be provided, with reference to the drawings, wherein like numbers refer to like parts. In particular, reference will be made to FIG. 1 through FIG. 15, wherein the improved card game embodying the principles and concepts of the present invention and generally designated by the reference numerals indicated will be described.

FIG. 2 through FIG. 15, taken together, illustrate the entire array of the playing cards used in the preferred embodiment of the present invention. Using FIG. 1 as an example of several cards, it can be appreciated that card 2 contains a layout presenting various information to be used by the card player in accordance with the instructions that will be suggested below. Card 2 contains a designation of the year 4. A single card for each year 4 from 1900 through 1998 is illustrated. It will be appreciated that the cards that would normally designate 1999 and the year 2000 are wild cards, and penalty cards respectively, and do not contain historical information since it can be unknown at the time of the present application. Card 2 for a particular year 4, contains a group of five icons representing various categories of historical events that are used in the play of the game for matching purposes. Considering FIG. 1 and particularly to card 2 for the year 1901, for example purposes, it can be seen that icons 6 through 14, inclusive, correspond to particular events within a category. Event icon 6 in the first row corresponds to chronological event 16. Likewise, second row icon 8 corresponds event 18. Each of the third, fourth and fifth row icons shown at 10 through 14 inclusive, correspond to the event description 20 through 24 as shown on FIG. 1. Major icons 15 as shown on FIG. 1 and other figures, are used for decorative design purposes only and to dress up the card. However, it could be appreciated when understanding the invention as fully described below that such major icons which appear on each card could be used for various new embodiments of the invention in accordance with the apparatus disclosed.

Figure 16:
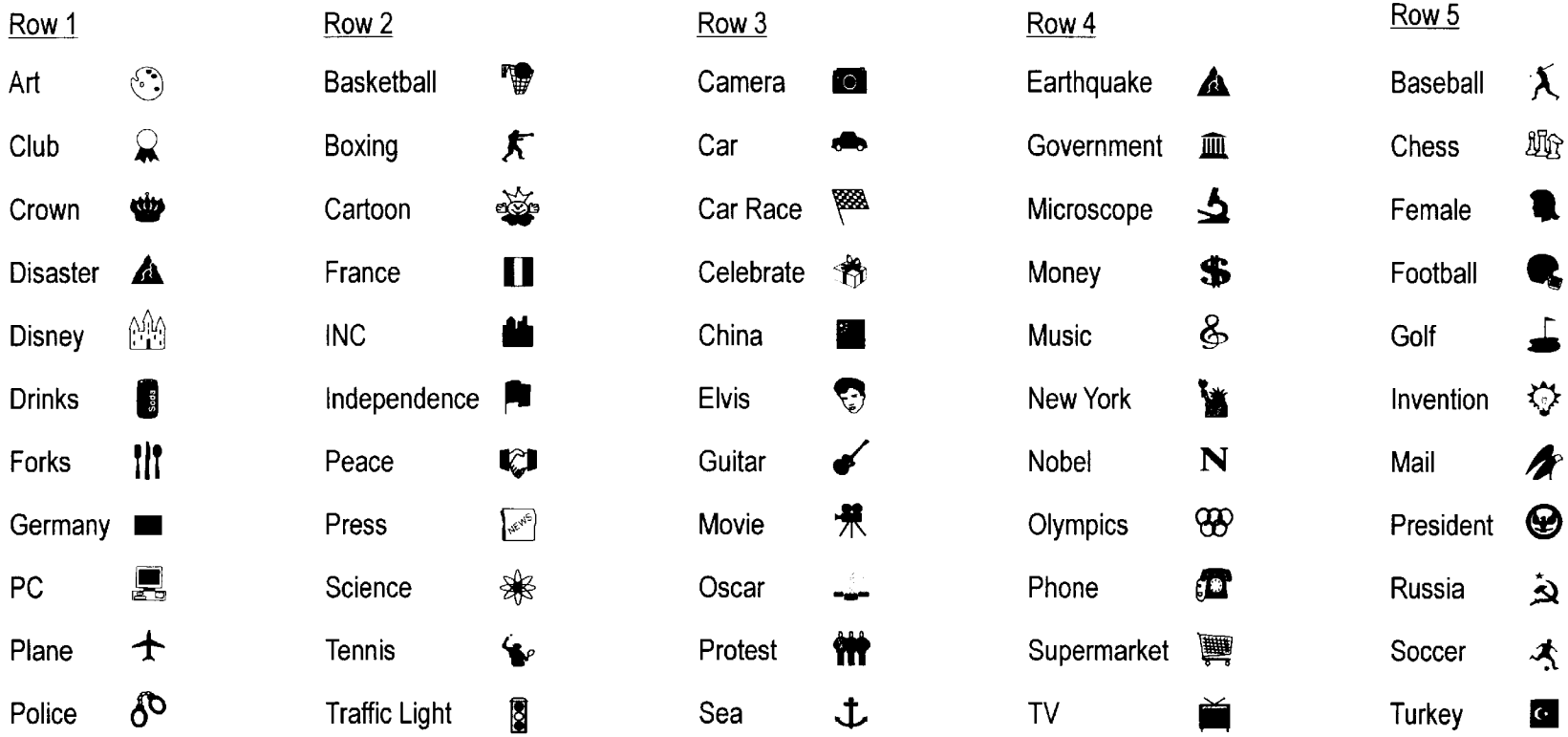
FIG. 16 is a chart of the present invention illustrating the subject matter icons presented with the definition of the icon used on the playing cards in FIG. 2 through FIG. 15.

FIG. 16 illustrates the array of every possible icon used in the preferred embodiment of the present invention. Row 1, corresponding to first row, icon 6 and description of the event 16 will always occur in row 1. Likewise, second row icon 8 which describes an event as shown "Australia gains its independence" at second row event 18, will always be found in the second row of any other playing card. Rows 3, 4, and 5 are presented in the same fashion thereby allowing a user of the apparatus to find quickly if more than one card being held by a player in any one game being played has matching icons. It will be appreciated that by selecting the icons for presentation in a fixed row, the user of the cards need not scan the second, third, fourth or fifth row, of the chronological event, if they are attempting to match a first row event such as displayed in the example card. FIG. 17 illustrates the frequency of occurrence of each individual category icon displayed in FIG. 16. The frequency of appearance of a particular category icon may be used to formulate alternative play of the game wherein each icon for each of said category equals a different scoring weight based on the probability of an appropriate match. In FIG. 17, there are some category icons that appear many more times than other category icons. Category icon for France, for example, found at Row 2 in the appearance on the cards, occurs only twice in the entire deck. By contrast, the icon for movie in Row 3 appears thirty five times in the cards presented in the preferred embodiment. Naturally, this can be altered depending on the emphasis which one may wish to place in the categories of the game. It should also be noted that the play of the game can best be accomplished by designing the apparatus such that icons 6 through 14 appear at the same x and y coordinates on each of the playing cards 2. This can be more greatly appreciated by considering a typical hand shown in FIG. 18 or in FIG. 19, whereby the icons in Rows 1 through 5 appear next to icons on an adjacent card when such cards are aligned in a playing hand format as suggested in said figures. This is an important aspect of the invention in that it allows a player to score a particular hand more quickly as described in the rules set forth below.

There are various ways that the present invention can be utilized in the play of the game. In what is referred to by the inventor as the "Century Classic", from two to eight people can play the game utilizing the apparatus in FIG. 1 through FIG. 15. The object of the game, as described earlier, is for a given player to be able to place down all of his cards using the protocol and scoring method described below.

In the play of this game, a first dealer is selected and that player shuffles and deals the cards in a conventional fashion usually providing one card at a time rotating through the number of players. The dealer gives one card, face down, to a player situated to the dealer's left side and continues dealing such cards in a clockwise direction giving one card to each player. The selected dealer repeats dealing such cards, one card at a time, until each player has ten cards. In the preferred embodiment, the dealer for each subsequent game can be selected from the person to the right of the previous dealer thereafter continuing in a such a rotation.

When each player has been dealt ten cards as indicated, the dealer places the remaining deck of cards face down in the center of the players, removing the top card and placing it face up next to the deck of cards remaining. Each player may draw a card from the face down deck or the face up pile, however, such player much then discard a card on to the face up discard pile, thereby leaving it available for the next player to select should that player choose to select such card from the face up pile.

For the first hand of the game in the preferred embodiment, a player holding the card representing the highest year will be first to draw. The player to the right of the first to draw will draw next and in turn the play of the game continues around the players in a counterclockwise direction. Each player, in turn, selects a card from either the face down deck or the face up discard pile as indicated. A card which is selected from the face down deck may either be placed in to the player's hand or discarded in to the face up discard pile. A card selected from the face up discard pile is needed by the player and therefore another card is discarded face up on the discard pile. In the event that all the face down cards in the draw pile are used before a player goes out of the game by getting rid of all of their cards, the face up discard pile is to be shuffled and placed face down as the new draw pile. Continuing as before, the top card is turned over and placed face up next to the draw pile to begin a new discard pile. The winner of the game in this embodiment is the first player to go out or to get rid of all of the cards in that player's hand of cards. Players get rid of cards by forming chains or matches and placing them face up on the playing area. A player may choose to keep chains or matches in their hand to keep others from knowing just how near that player is to going out of the game and thereby winning. However, cards in hand will be counted against the player if another goes out first. This provides a requirement for tactical decision on behalf of the players during the play of the game. Players may add to their own chains or matches after laying them down. Other players may not add to or draw from the cards placed down by any individual player in their chains or matches.

In the preferred embodiment, a chain can be defined as three or more cards where the year 4 are in sequence. For example, if a player has cards for 1925, 1926, and 1927 in hand, this is considered a chain for the purposes of playing the game as presently instructed.

A match in this embodiment, would be two or more cards with the same symbol or icon. For example, in observing FIG. 1 we see the card where year 4 is 1900 matches the card with year 4 at 1901 at icon 14. Icon 14 as shown in FIG. 1 is the symbol for an invention which, as can be demonstrated in FIG. 1, matches for the two years in question. In this case, there is a match of the icon for the purpose of the play of the game.

Figure 15:
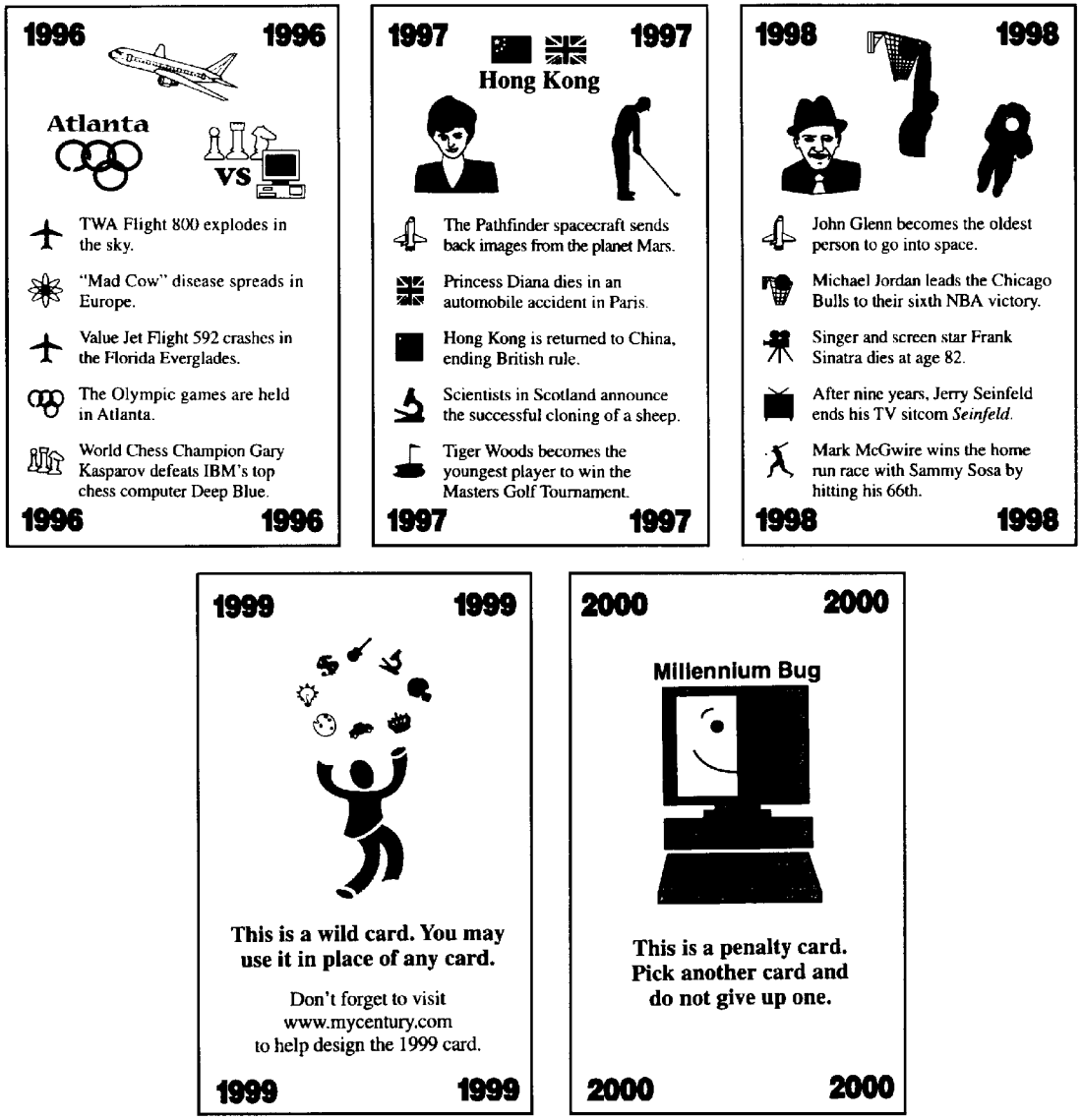

Wild cards as illustrated in FIG. 15 may be used in place of any card to create a chain or match. Each player may use the card bearing the player's birth year as a wild card for that player. The year 1999, when appearing at year 4 on the card, is a wild card for all players.

In this embodiment of the game, the year 2000 card is a penalty card. A player holding this card may declare it by placing the year 2000 card face up in the playing area. In such a case, the player drawing the card must draw another card without discarding any of the cards in hand, thus being penalized by holding an additional card. A player failing to declare holding the year 2000 card will avoid the penalty draw but risks being caught with the 2000 card in hand and incurring additional penalties if another player goes out of the game first as described above. In this fashion, yet another tactical element in the play of the game is added to this embodiment.

Keeping score is straightforward with the present instruction set in that the first player to get rid of their cards is out of the game and wins one point. Other players remaining receive minus three points for every chain or match they did not lay down and are also assessed three points for any penalty card not declared as described above. This score keeping method can be enhanced for those players wishing to do so without a change in the apparatus in the present invention. An advanced method of play involves the first player to get rid of their cards goes out and wins two hundred points. Each of the other players receive a score determined by subtracting the lowest year held in their hands from the highest year held in their hands. The difference is the number of points which that player receives. Players then receive minus one hundred points for each chain or match that they did not lay down, and minus one hundred points for each penalty card held in hand as described above.

An entirely different play of the game is established with the same apparatus described in FIG. 1 through FIG. 15 in the protocol referred to by the inventor as "Century Chain". Once again, as in the above described play protocol, two to eight people can play, where the object remains to get rid of all the cards in a given player's hand using the rules of such play as described below. After dealing the cards as described above or in any conventional fashion, the player holding the card representing the highest year 4 starts the game. To play the game in this protocol, you remove the cards for the year 4 from the deck, which is for 1999 and 2000, before beginning. The dealer gives one card face down to each player situated in a rotation and continues dealing in the rotation giving one card to each player. The dealer repeats dealing one card at a time until each player has ten cards. When each player has been dealt ten cards, the dealer places the remaining deck of cards face down in the center of the players, removing the top card and placing it face up next to the deck to begin a discard pile as described above. After the first player begins, a conventional rotation can be determined. The object of the game is for each player to try to be the first to go out of the game by laying down all of their cards.

During a turn, each player will attempt to place a card from their hand into the discard pile. In order to do this, the player must be holding a card that will either match the face up card or be chained with it using the instructions for same described above. A chain involves year 4 matching in numerical order, and a match involves lining up icons as illustrated in FIG. 1, icons 6 through 14 inclusive. A given player, when acting in turn, may continue placing cards on the discard pile as long as that player can continue to match or chain the top card in the face up discard pile. When the first player has exhausted all possibilities for playing, the second player then takes a turn in to accomplish the same ends. In the event that a given player, when selected, does not have any cards that will either match or chain with the face up card, the player must draw a card from the face down deck. The player's turn ends after drawing a card. That card drawn from the deck can not be played until the player's next turn. In the event that all face down cards in the draw pile are used before a player goes out or gets rid of all of their cards, the face up discard pile is to be shuffled and placed face down as the new draw pile. Play continues until a player gets rid of all the cards in that player's hand. In this protocol of the play of the game, the first player to go out gets one point and the rest of the players get zero points, thereby accumulating rounds of play and keeping score in such a fashion.

In another protocol of the game, using the very same apparatus described above, can be played. Referred to by the inventor as "Century Face-off", the object of this alternate protocol is to collect the largest pile of year cards 2. Two to eight players can play with the player holding the card representing the highest year after a deal starting the game. The round begins by a first player laying down one of that player's ten card, face up in the center of the playing area. The player adjacent to such first player will be next to lay down a card and the turn continues rotating in a direction agreed by the players until each player has played one card. The player laying down the card with the highest date wins the round. In this protocol, the year 2000 card has no value. It can not therefore be counted upon to win a pile or to determine the first player. The winner collects and keeps the pile of cards and becomes the first player in the next round. Once the players use all of the cards in their hands, the selected dealer will again deal each player ten cards or as many as might be remaining from the deck to allow an equal number of cards to be dealt from such deck. The play continues until all of the cards in the deck have been played.

The winner in this protocol or the use of the disclosed apparatus is that player that has collected the most piles of cards. In scoring, it is suggested that one point is counted for each hand that is one as described above. Five points should be added if a player holds the card the player's own year of birth. Yet another five points could be awarded to the player holding the year 1999 during the play of the game as above described.

Figure 18:
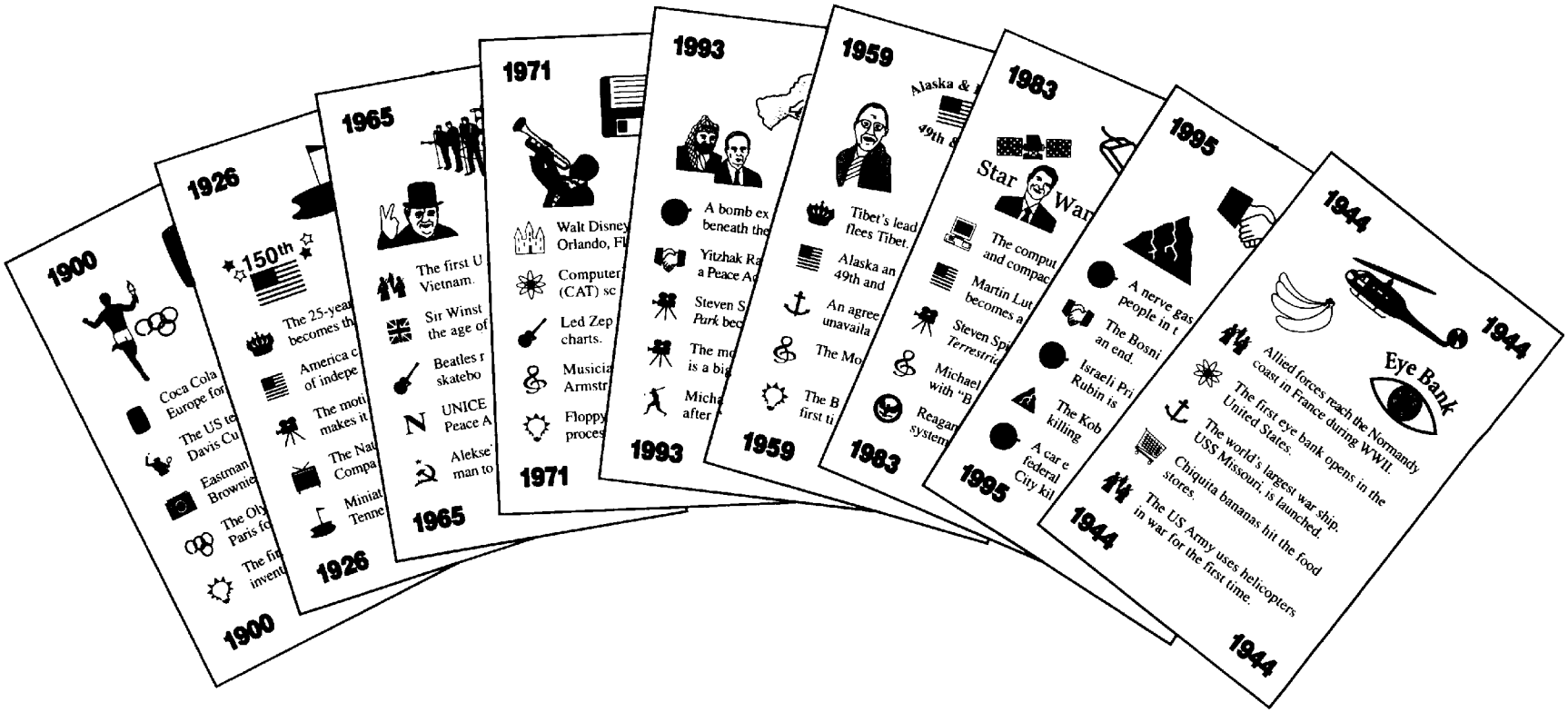
FIG. 18 is a plain view of a typical set of playing cards as may be held by a player using the invention, showing possible icon matches.
Figure 19:
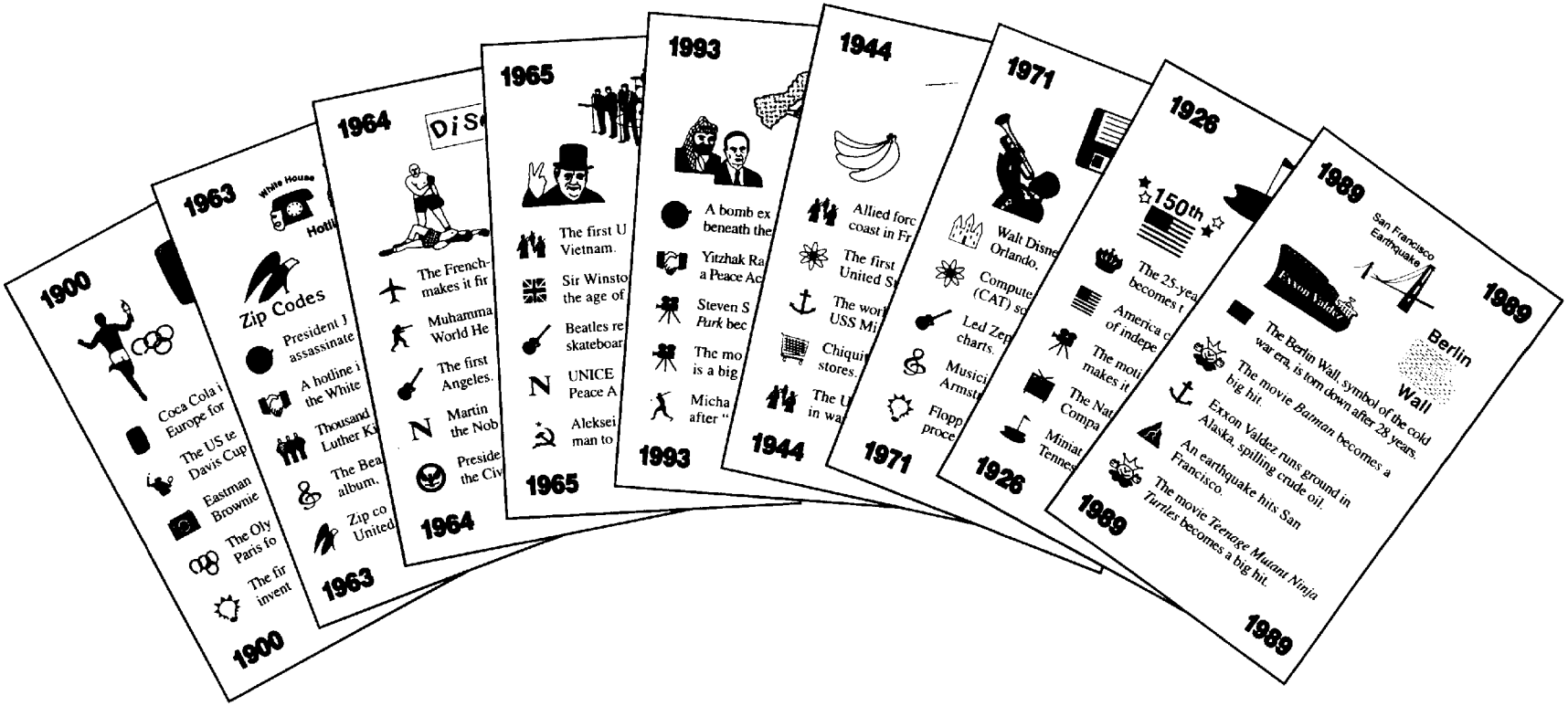
FIG. 19 is a plain view of a typical set of playing cards as may be held by a player using the invention, showing years in order.

Returning to FIGS. 18 and 19, the play of the game as described above in one or more of the rule sets provided can be more fully appreciated by considering the example set forth therein. FIG. 18 illustrates a typical hand of cards held by a player showing matches of icons along the left side of the displayed card. For example, it could be appreciated that the card for 1926, 1959 and 1983 match an American flag in the second row of the icon array. Likewise, it can be appreciated that on the years 1900, 1971, and 1959, the light bulb icon on the last row of each of said cards also match. FIG. 19 illustrates another scoring mechanism as described above whereby sequential years will be placed in order. In considering FIG. 19, it can be again appreciated that the years 1963, 1964, and 1965 as illustrated, are sequential years and are therefore a scoring mechanism as described above.

It can be appreciated by those skilled in the art that numerous changes and details of the construction of the cards used in the play of the game may be devised. Alterations of the presentation of the icons selected or the actual use of the icons themselves may be provided without changing the spirit and scope of the game. Also, the game protocol and the apparatus demonstrated can be reproduced using a computer or other electronic hardware that can simulate the play of the game using the same technique and style set forth above. In such a case, simulations on a video screen would present virtual cards, including the information contained on such cards, in any fashion a programmer may desire. Using such virtual cards would allow the play of the game as suggested above using the same protocol and rules to obtain the same results.

Although the present invention has been described with reference to the particular embodiments here and set forth, it is understood that the present disclosure has been made only by way of example and that numerous changes in details of construction, presentation and play of the games involved with the apparatus may be resorted to without departing from the spirit and scope of the invention. Thus, the scope of the invention should not be limited by the foregoing specifications which provide such examples, but rather only by the scope of the claims appended hereto.

I claim:

1. A history based card game comprising:

a) a set of game cards representing a plurality of different years, each game card having imprinted thereon an individual year to represent said individual year, and each said card designated by said year containing an array of historical facts that occurred in said year, each said historical fact on said card aligned in conjunction with an associated icon relating to a category of said historical facts.

* * * * *